United States Patent [19]

Imai

[11] Patent Number: 4,632,537

[45] Date of Patent: Dec. 30, 1986

[54] ELECTROPHOTOGRAPHIC APPARATUS

[75] Inventor: Chikara Imai, Tokyo, Japan

[73] Assignee: Ricoh Company, Ltd., Japan

[21] Appl. No.: 721,855

[22] Filed: Apr. 10, 1985

[30] Foreign Application Priority Data

Apr. 13, 1984 [JP] Japan ..... 59-074614

[51] Int. Cl.[4] ..... G03G 15/08

[52] U.S. Cl. ..... 355/14 D; 355/3 DD; 118/624; 118/663; 430/30

[58] Field of Search ..... 355/14 D, 3 DD, 3 CH, 355/14 CH, 3 SH; 118/653, 624, 663; 430/120, 126, 30

[56] References Cited

U.S. PATENT DOCUMENTS

| | | | |
|---|---|---|---|
| 4,239,374 | 12/1980 | Tatsumi et al. | 355/14 D X |
| 4,313,671 | 2/1982 | Kuru | 355/14 D |
| 4,419,010 | 12/1983 | Grombone et al. | 355/3 DD X |
| 4,462,680 | 7/1984 | Ikeda | 355/14 D |
| 4,466,731 | 8/1984 | Champion et al. | 355/14 D |
| 4,466,732 | 8/1984 | Folkins | 355/14 D |
| 4,468,112 | 8/1984 | Suzuki et al. | 355/14 D |
| 4,522,481 | 6/1985 | Imai et al. | 355/3 DD |
| 4,536,082 | 8/1985 | Motohashi et al. | 355/3 SH |

*Primary Examiner*—A. C. Prescott

*Attorney, Agent, or Firm*—Guy W. Shoup

[57] ABSTRACT

An electrophotographic apparatus is operable selectively in an image-forming mode and a checking mode. In the checking mode, a region of a photosensitive body or drum having a uniform surface potential is developed by a developing unit at a plurality of different developing bias voltages into toner amount detecting regions.

6 Claims, 2 Drawing Figures

ELECTROPHOTOGRAPHIC APPARATUS

BACKGROUND OF THE INVENTION

1. Field of the Invention

The present invention relates to an electrophotographic apparatus such as a copying machine, a printer, or the like which has an arrangement for checking the developing ability of the apparatus.

2. Description of the Prior Art

Electrophotographic apparatus which employ a wet-type or dry-type two-ingredient developing agent for producing visible images generally have a toner density control means including a toner density sensor for controlling the toner density of the two-ingredient developing agent in order to maintain a constant developing ability. The developing ability of the electrophotographic apparatus is however subject to a change due for example to the deterioration of the toner density sensor or the deterioration of the two-ingredient developing agent, resulting in degraded image quality. It is therefore necessary to check the developing ability and remove any change in the developing abiltity when it varies. In checking the developing ability, a skilled engineer can immediately determine a failure of the toner density sensor and control or a deterioration of the two-ingredient developing agent from a visible image which has been developed. However, general users have difficulty in pinpointing which image forming process is responsible for changes in image quality simply by looking at the developed image.

SUMMARY OF THE INVENTION

It is an object of the present invention to provide an electrophotographic apparatus which allows a general user to check the developing ability of the apparatus with ease.

According to the present invention, there is provided an electrophotographic apparatus comprising a cyclically operable photosensitive body, means for forming a latent image on the photosensitive body, a developing unit having a developing electrode supplied with a prescribed developing bias voltage for developing the latent image into a toner image with a two-ingredient developing agent, means for transferring the toner image from the photosensitive body to a transfer sheet, means for controlling the density of toner in the two-ingredient developing agent, means for selectively establishing a checking mode, and means for applying a plurality of different developing bias voltages to the developing electrode in the checking mode to enable the developing unit to develop a region of the photosensitive body having a uniform surface potential into toner amount detecting regions on the photosensitive body.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
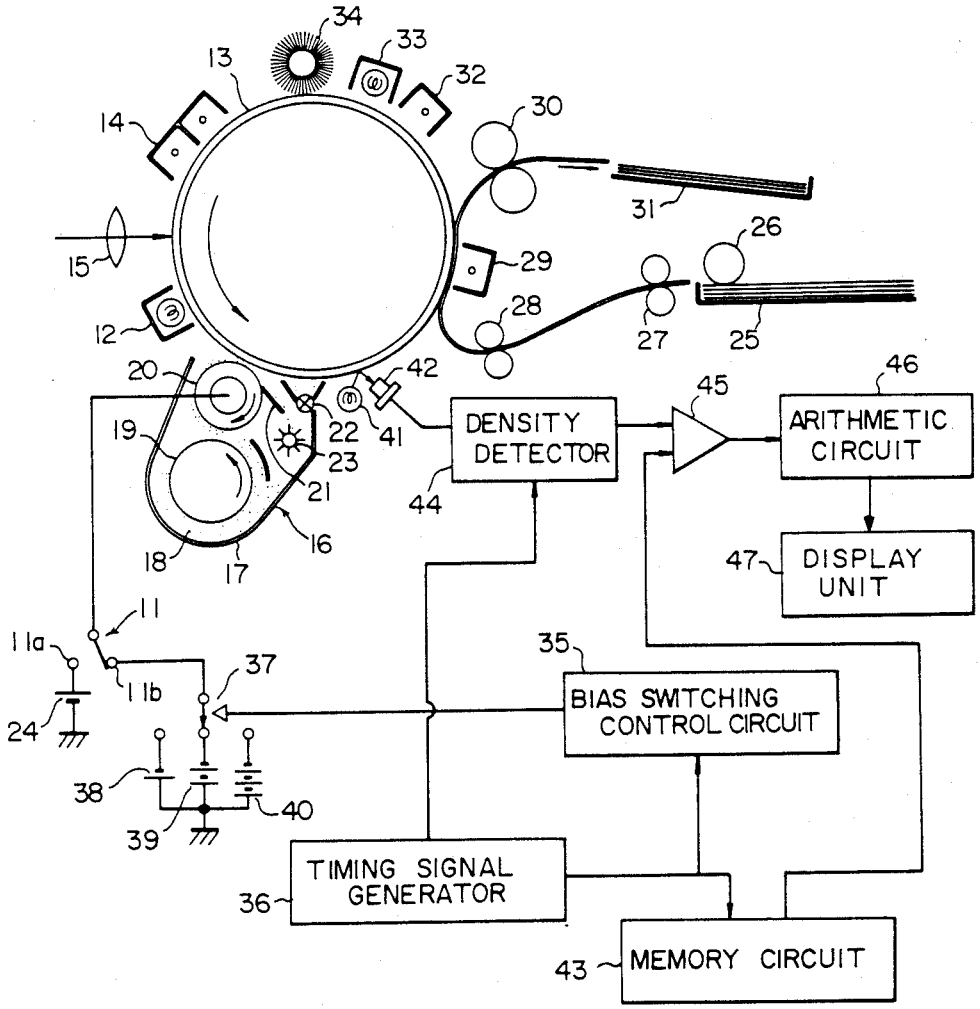
FIG. 1 is a schematic diagram, partly shown in block form, of an electrophotographic apparatus according to the present invention.

FIG. 1 illustrates an electrophotographic apparatus according to the present invention. The illustrated electrophotographic apparatus is selectively operable in an image-forming mode and a checking mode which are selected by the operator through a control unit. In the image-forming mode, the movable contact of a switch 11 is moved by the operator into contact with a fixed contact 11*a* to de-energize an erase lamp 12. When the operator depresses a print switch, a cyclically operable photosensitive drum 13 is rotated by a motor (not shown) and uniformly charged by a charging corona discharger 14. Thereafter, a light image is projected by an exposure unit 15 onto the photosensitive drum 13 to form an electrostatic latent image thereon, which will be developed by a developing unit 16. The exposure unit 15 projects either the light image of an original placed on an original support or the light image produced from an input image signal. The developing unit 16 includes a container 17 containing a two-ingredient developing agent 18 composed of a toner and a carrier, a scooping roller 19 for taking up the developing agent 18, and a developing roller 20 for supplying the developing agent 18 to the surface of the photosensitive drum 13 to develop the electrostatic latent image on the drum 13. The developing unit 16 also has a scraper 21 for scraping residual developing agent off the developing roller 20 after the developing agent has passed the developed position on the drum 13. The developing agent from the scraper 21 and the toner from a toner supply unit 22 are mixed together by a mixer 23. The toner in the two-ingredient developing agent 18 is charged to a polarity opposite to that of the electrostatic latent image on the drum 13 by friction action between the toner and the carrier while the developing agent 18 is mixed by the mixer 23 and delivered upwardly by the scooping roller 19. The developing roller 20 doubles as a developing electrode for applying a developing bias voltage, having the same polarity as that of the toner the developing bias being supplied through the switch 11 from a biasing power supply 24.

A density sensor composed of a light source 41 and a photodetector 42 optically detects the density of a developed image on the drum 13, i.e., the amount of toner attached to the drum 13. When a detected signal from the density sensor drops below a predetermined value (i.e., when the developing ability of the developing unit 16 is lower than a reference level), a toner density control circuit (not shown) operates the toner supply unit 22 to add more toner to the developing agent.

An image transfer sheet preferably made of paper is fed by a feed roller 26 from a paper cassette 25 and conveyed by delivery rollers 27, 28 onto the photosensitive drum 13. Then, the toner image is transferred from the photosensitive drum 13 to the image transfer sheet, and fixed thereto by a fixing unit 30. The image transfer sheet is thereafter discharged into a tray 31. After the toner image has been transferred, the photosensitive drum 13 is discharged by a discharging corona discharger 32 and a discharging lamp 33, and remaining toner is cleaned from the drum 13 by a cleaning brush 34.

In the checking mode for checking the developing ability of the electrophotographic apparatus, the movable contact of the switch 11 is brought by the operator into contact with a fixed contact 11*b* to energize the erase lamp 12. In response to the depression of the print switch, the photosensitive drum 13 is rotated by the motor and uniformly charged by the charging corona discharger 14. The surface of the photosensitive drum 13 as it is moved past the exposure unit 15 is entirely illuminated with light emitted from the erase lamp 12 so that the surface potential of the drum 13 will be uniformly charged at a saturated residual potential which is substantially 0 V. Then the electrostatic latent image on the photosensitive drum 13 is developed by the developing unit 16. At this time, a bias switching control circuit 35 is responsive to a timing signal from a timing signal generator 36 for successively changing over a switch 37 to apply the developing bias voltages of biasing power supplies 38, 39, 40 successively to the developing roller 20. Therefore, while the electrostatic latent image on the photosensitive drum 13 is being developed (i.e., during one revolution of drum 13) the drum area being developed is subjected to the three different developing bias voltages which have the same polarity as that of the toner. Therefore, three regions are formed on the drum 13 which serve as toner amount detecting regions having different amounts of toner attached thereto, which are detected by the density sensor composed of the light source 41 and the photodetector 42. An image transfer sheet of paper is fed by the feed roller 26 from the paper cassette 25 and conveyed by the delivery rollers 27, 28 onto the photosensitive drum 13. Then, the toner is transferred from the toner amount detecting regions on the photosensitive drum 13 to the image transfer sheet, and the toner images are fixed thereto by the fixing unit 30. The image transfer sheet is thereafter discharged into the tray 31. After the toner has been transferred, the photosensitive drum 13 is discharged by the discharging corona discharger 32 and the discharging lamp 33, and remaining toner is cleaned from the drum 13 by the cleaning brush 34.

A memory circuit 43 stores three reference density signals representative of predetermined reference densities respectively for the three toner amount detecting regions on the drum 13. The three reference density signals are successively read out of the memory circuit 43 by a timing signal from the timing signal generator 36 in timed relation to the detection of the toner densities of the three toner amount detecting regions. A density detector 44 is responsive to a timing signal from the timing signal generator 36 for generating a density signal indicative of the density detected by the density sensor for each of the toner amount detecting regions. The density signal generated by the density detector 44 is compared by a comparator 45 with the reference density signals from the memory circuit 43. An arithmetic circuit 46 detects, in a manner described later, a high or low magnitude of the toner density and the degree of deterioration of the toner density based on the result of comparison in the comparator 45, and displays the detected states on a display unit 47.

When the image area (black) of the photosensitive drum 13 is of higher density, it may be caused by either (1) a higher potential of the photosensitive drum 13 or (2) a higher ability of the developing agent (the toner density is higher or the amount of toner charging is lower). When the background area of the photosensitive drum 13 is smeared with toner, that condition may be caused by either (3) a higher potential of the photosensitive drum 13, or (4) a lower amount of exposure, or (5) a deterioration of the photosensitive drum 13, or (6) a higher ability of the developing agent. According to the illustrated arrangement, since the developing ability is detected by keeping the photosensitive drum 13 at a uniform potential, the change in the developing ability ((2) and (6) described above) can be ascertained without being affected by the conditions (1), (3) through (5). The potential of the photosensitive drum 13 can be assumed uniformly charged to the uniform potential which is substantially 0 V. Although latent images are not developed in general if the drum potential is 0 V, the toner is attracted and attached to the photosensitive drum 13 since the developing bias voltages of the biasing power supplies 38, 39, 40 have the same polarity as that of the toner.

Figure 2:
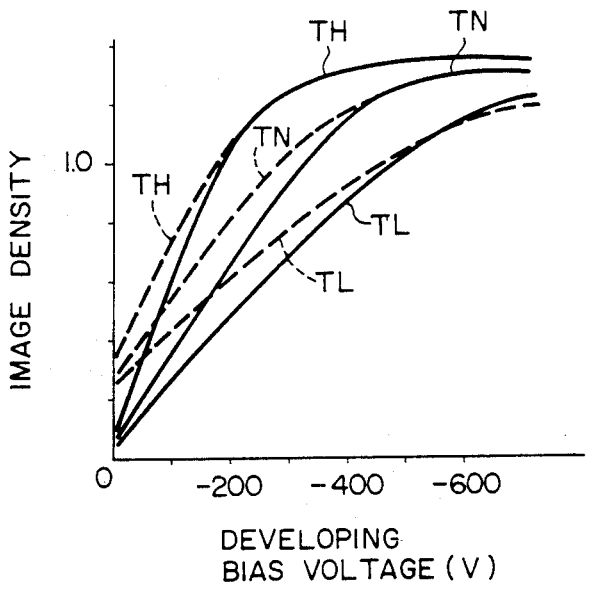
FIG. 2 is a graph showing the relationship between image densities and developing bias voltages in the electrophotograhic apparatus shown in FIG. 1.

FIG. 2 shows the relationship between developing bias voltages and image densities on an image transfer sheet at the time the developing bias voltage applied to the developing roller 20 is successively changed in the checking mode. The solid-line curves represent characteristics obtained when a new developing agent 18 is used, and the dotted-line curves represent characteristics obtained when a deteriorated developing agent 18 is used. The characteristic curves indicated by TN are plotted when the toner density is equal to a reference density. The characteristic curves indicated by TH are plotted when the toner density is higher than the reference density. The characteristic curves indicated by TL are plotted when the toner density is lower than the reference density. FIG. 8 clearly shows that the relationship between the developing bias voltage and the image density varies depending on the variation in the toner density and the deterioration of the developing agent 18. The image density, varies greatly in a medium-to-high density range depending on the toner density, and also varies greatly in a low-to-medium density range depending on the deterioration of the developing agent 18. The conditions of the developing agent (i.e., the variation in the toner density and the deterioration of the developing agent) can be determined by comparing, through a visual inspection, the image densities on the image transfer sheet developed at the developing bias voltages of 0 V and somewhere between about −400 and −500 V, with a prescribed reference density on paper. This checking process can be carried out while saving time and transfer paper by switching the developing bias voltage between 0 V and −450 V during one checking mode (i.e., while the photosensitive drum makes one revolution). By changing the developing bias voltage between three voltage values or more in one checking mode, there become available three or more toner amount detecting regions for more accurate information.

In the illustrated embodiment, the developing bias voltage of each of the biasing power supplies 38, 39, 40 is set to two values, that is, substantially 0 V and −450 V. The comparator 45 compares a first density signal representative of the density in the first toner amount detecting region developed at the developing potential of 0 V based on the developing bias voltage which is substantially 0 V, with the corresponding reference density signal. Based on the comparison signal from the comparator 45, the arithmetic circuit 46 calculates a deterioration of the developing agent 18 and enables the display unit 47 to display the calculated deterioration. At the same time, the arithmetic circuit 46 calculates a variation in the toner density from the results of comparison of two next density signals representative of the densities (medium and high) in the two toner amount detecting regions developed at prescribed developing potentials, with the corresponding reference density signals, and displays the calculated toner density variation on the display unit 47.

While in the foregoing embodiment the surface potential of the photosensitive drum 13 is equalized to the saturated residual potential by the erase lamp 12 in the checking mode, the surface potential of the drum 13 may be brought to 0 V by de-energizing the charging corona discharger 14. In the checking mode, the surface potential of the photosensitive drum 13 may be brought to an appropriate uniform potential other than 0 V. With this alternative, the developing bias voltage of the biasing power supply 38 is equalized to the above uniform potential, and the deterioration of the developing agent is checked by the amount of toner attached when an image is developed at the developing potential of 0 V in the same manner as described in the illustrated embodiment. Then, the developing bias voltages of the biasing power supplies 39, 40 are increased so as to be higher than the foregoing uniform potential for checking any variation in the toner density in the same manner as described above.

While in the illustrated embodiment the three toner amount detecting regions are formed on the photosensitive drum during one revolution thereof, one region of the photosensitive drum may be turned successively into toner amount detecting regions where toner is attached in different amounts.

With the arrangement of the present invention, as described above, a region of the photosensitive drum having a uniform surface potential is developed by the developing unit at a plurality of different developing bias voltages into toner amount detecting regions. A change in the toner density and a deterioration of the developing agent can be determined on the basis of a variation in the amount of attached toner in the toner amount detecting regions, thus enabling a general user to easily check the developing ability of the electrophotographic apparatus.

Although a certain preferred embodiment has been shown and described, it should be understood that many changes and modifications may be made therein without departing from the scope of the appended claims.

What is claimed is:

1. An electrophotographic apparatus comprising:

(a) a cyclically operable photosensitive body;

(b) means for forming a latent image on said photosensitive body;

(c) a developing unit having a developing electrode supplied with a prescribed developing bias voltage for developing said latent image into a toner image with a two-ingredient developing agent;

(d) means for transferring the toner image from said photosensitive body to a transfer sheet;

(e) means for controlling the density of toner in said two-ingredient developing agent;

(f) means for selectively establishing a checking mode; and (g) means for applying a plurality of different developing bias voltages to said developing electrode in said checking mode to enable said developing unit to develop a region of said photosensitive body having a uniform surface potential into toner amount detecting regions on said photosensitive body.

2. An electrophotographic apparatus according to claim 1, including means for transferring toner from said toner amount detecting regions to a transfer sheet for visually checking a developing ability based on the amount of toner attached to the transfer sheet.

3. An electrophotographic apparatus according to claim 1, including means for detecting the amounts of toner attached in said toner amount detecting regions to determine a developing ability.

4. An electrophotographic apparatus according to claim 3, including means for displaying the determined developing ability.

5. An electrophotographic apparatus according to claim 1, wherein said region of the photosensitive body having the uniform surface potential is developed into the toner amount detecting regions by said developing unit through switching between said developing bias voltages in said checking mode.

6. An electrophotographic apparatus according to claim 1, wherein said region of the photosensitive body having the unifrom surface potential is developed into a single toner amount detecting region a plurality of times by said developing unit through successive application of said developing bias voltages in said checking mode.

* * * * *